US009174254B2

(12) United States Patent
Marga et al.

(10) Patent No.: US 9,174,254 B2
(45) Date of Patent: Nov. 3, 2015

(54) ADJUSTABLE PROFILE PLATE ASSEMBLY FOR USE WITH AN AIR MAKE-UP SYSTEM

(75) Inventors: Nicolae Marga, Toronto (CA); Joseph B. Zavitz, Courtice (CA)

(73) Assignee: GM Global Technology Operations LLC, Detroit, MI (US)

( * ) Notice: Subject to any disclaimer, the term of this patent is extended or adjusted under 35 U.S.C. 154(b) by 1532 days.

(21) Appl. No.: 12/265,069

(22) Filed: Nov. 5, 2008

(65) Prior Publication Data

US 2010/0112927 A1 May 6, 2010

(51) Int. Cl.
*F24H 3/02* (2006.01)
*B08B 15/00* (2006.01)

(52) U.S. Cl.
CPC ..... *B08B 15/00* (2013.01)

(58) Field of Classification Search
CPC ..... F24H 3/02
USPC ..... 454/50; 126/110 C
See application file for complete search history.

(56) References Cited

U.S. PATENT DOCUMENTS 3,591,150 A 7/1971 Weatherston
3,976,244 A 8/1976 Logsdon
5,346,130 A * 9/1994 Rademaker ..... 236/49.5
5,915,960 A * 6/1999 Check et al. ..... 432/222
6,629,523 B2 10/2003 Saltzman et al.
6,921,261 B2 * 7/2005 Perry ..... 431/351

FOREIGN PATENT DOCUMENTS

DE 1957869 3/1967
GB 1458363 12/1976

OTHER PUBLICATIONS

English translation of Allfen Daemmglas Wilma Voss (DE 1957869).*
German Office Action dated Jan. 18, 2011, (3 pages).

* cited by examiner

*Primary Examiner* — Steven B McAllister
*Assistant Examiner* — Samantha Miller
(74) *Attorney, Agent, or Firm* — Reising Ethington P.C.; Lionel D. Anderson

(57) ABSTRACT

An adjustable profile plate assembly for use with an air make-up system. According to an exemplary embodiment, the adjustable profile plate assembly includes a slidable profile plate, a scissor-type linkage mechanism attached to the profile plate, and an actuator attached to the linkage mechanism for driving the profile plate back and forth in a widthwise direction B. The adjustable profile plate assembly may use a feedback control loop that uses one or more operational parameters, such as the operational state of fans that draw air into the system, in order to control the actuator.

11 Claims, 1 Drawing Sheet

ADJUSTABLE PROFILE PLATE ASSEMBLY FOR USE WITH AN AIR MAKE-UP SYSTEM

TECHNICAL FIELD

The present invention generally relates to air make-up systems and, more particularly, to profile plate assemblies that are used in air make-up systems.

BACKGROUND

Typically, air make-up systems condition outdoor air for distribution to a working area in order to replenish gases that are exhausted out of the working area. In essence, air make-up systems may help replace exhausted or otherwise unsuitable gases with fresh air. These types of systems are oftentimes used in working areas that emit gas that is unsuitable for inhalation; examples of such working areas may include sections of manufacturing plants, laboratories, and commercial kitchens. Air make-up systems commonly include a heating element for heating the outdoor air, and can include one or more profile plates to help direct the outdoor air.

One example of an air make-up system is a direct-fired air make-up system, which typically includes a gas burner as the heating element and profile plates bolted down near the gas burner. Traditionally, these profile plates were unadjustable and were not able to adjustably manipulate the airflow across the gas burner.

SUMMARY OF THE INVENTION

According to one embodiment, there is provided an adjustable profile plate assembly for use with an air make-up system. The profile plate assembly may include a profile plate, a linkage mechanism, and an actuator. The linkage mechanism is attached to the profile plate and to the air make-up system. The actuator is attached to the linkage mechanism and to the air make-up system. When activated, the actuator causes the linkage mechanism to adjust the position of the profile plate.

According to another embodiment, there is provided an adjustable profile plate assembly for use with an air make-up system. The profile plate assembly may include one or more mounting brackets, an elongated profile plate, and an actuator. The mounting bracket is mounted to the air make-up system, and the profile plate is slidably supported by the mounting bracket. The profile plate has a lengthwise dimension that is greater in value than its widthwise dimension. The actuator is coupled to the profile plate and, when activated, causes the profile plate to move back and forth in the widthwise direction.

According to another embodiment, there is provided an adjustable profile plate assembly for use with an air make-up system. The profile plate assembly may include one or more mounting brackets, an elongated profile plate, a scissor-type linkage mechanism, an actuator, and an electronic control unit. The mounting bracket is mounted to the air make-up system, and the profile plate is slidably supported by the mounting bracket. The profile plate has a lengthwise dimension that is greater in value than its widthwise dimension. The scissor-type linkage mechanism is attached to the profile plate and to the air make-up system. The actuator is attached to the scissor-type linkage mechanism and to the air make-up system, and when activated, causes the profile plate to move back and forth in the widthwise direction. The electronic control unit has an electronic input and an electronic output. The electronic input receives one or more operating parameters from the air make-up system, the electronic control unit uses the operating parameter, and the electronic output sends a control signal to the actuator.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

The adjustable profile plate assembly described herein may be used in an air make-up system, such as a direct-fired air make-up system, to control or direct outdoor air flowing into the air make-up system. The profile plate assembly adjusts to direct the outdoor air towards and away from a heating element of the air make-up system, and in some cases does so by automatic and/or remote control. Although the following description is provided in the context of an exemplary manufacturing plant and a direct-fired air make-up system, it should be appreciated that the profile plate assembly is not limited to those applications. For example, the profile plate assembly could be used in air make-up systems that are installed in laboratories, commercial kitchens, and other suitable working areas, and could be used with air make-up systems that have cooling and air conditioning elements, to cite a few possibilities.

Figure 1:
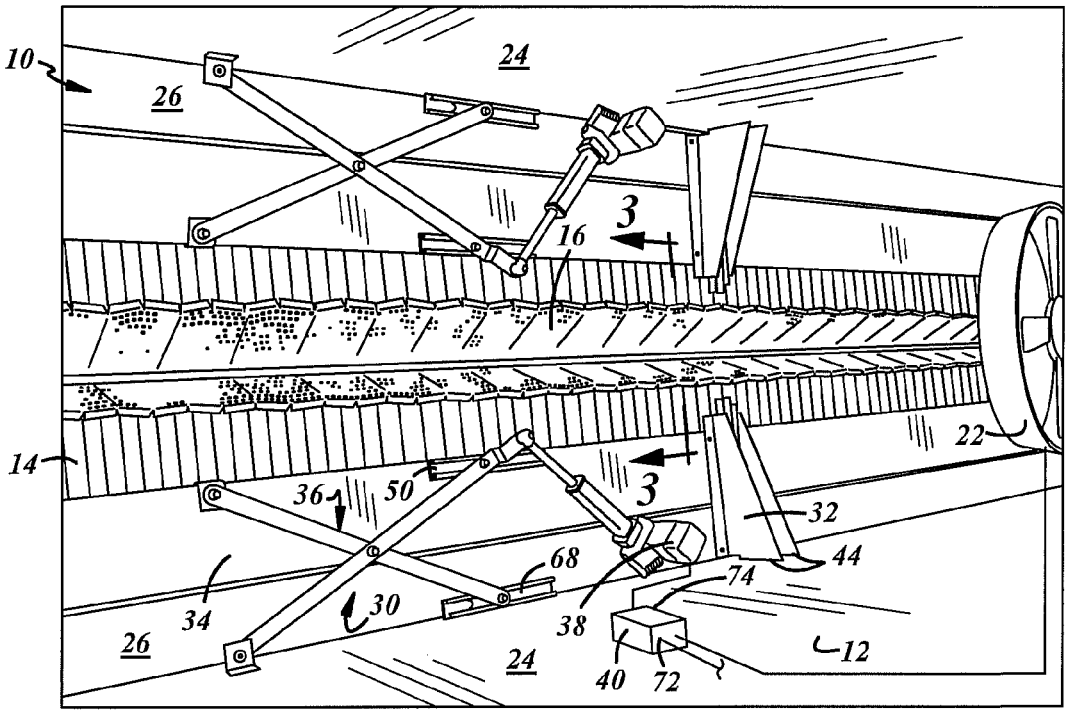
FIG. 1 is a perspective view of an exemplary embodiment of an air make-up system and adjustable profile plate assembly, where the perspective view is looking up at the underside of the air make-up system.

With reference to FIG. 1, there is shown an exemplary direct-fired air make-up system 10 that draws and heats outdoor air, and then uses this air to replenish gases that are exhausted out of a manufacturing plant, such as an automotive paint facility. According to the embodiment shown here, air make-up system 10 includes a housing 12, an air inlet 14, a heating element 16, and one or more fans 22.

Figure 3:
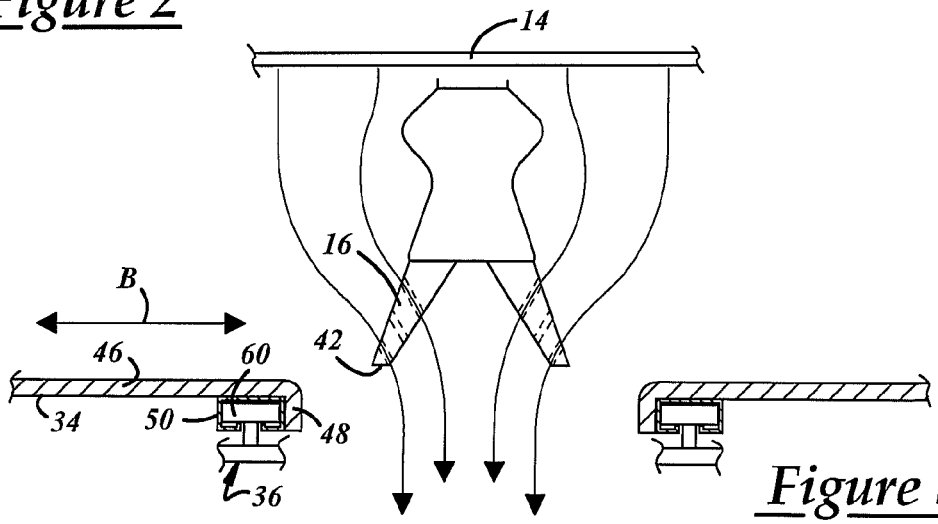
FIG. 3 is a sectioned view of an exemplary profile plate of the adjustable profile plate assembly of FIG. 2, showing the adjustment of the profile plate with respect to a heating element of the air make-up system.

Housing 12 can be an enclosed structure that includes side walls 24 and a ceiling 26. Air inlet 14 is a long opening located in ceiling 26 and can have one or more opening and closing structures to controllably admit outdoor air flowing into housing 12. In the particular embodiment shown here, air inlet 14 is covered by a number of louvers that extend across the width of the inlet and control the amount of air that is drawn in from the outside. Heating element 16 is located downstream of air inlet 14 (i.e., it is located beneath the inlet) and may use some of the admitted outdoor air for combustion, while the remaining outdoor air is heated as it passes by a burner or the like. In the embodiment of FIG. 1, which shows air-make up system 10 from an underside, heating element 16 includes a long gas-fired burner that extends down the middle of inlet 14 such that incoming air must pass by the burner and be heated in the process. Of course, other heating elements with different cross-sectional profiles than that shown in FIG. 3 are possible. Fans 22 are located downstream of heating element 16 and draw outdoor air through the air inlet, past the burner, and into the housing. It should be appreciated that air make-up system 10 could have more, less, and/or different components than shown and described here. For instance, additional heating elements and fans could be provided, one or more filters could be added, and another device for bringing outdoor into the housing could be used such as a device that forces air into the housing instead of sucking air therein. These are, of course, only some of the possibilities, as others exist as well.

Figure 2:
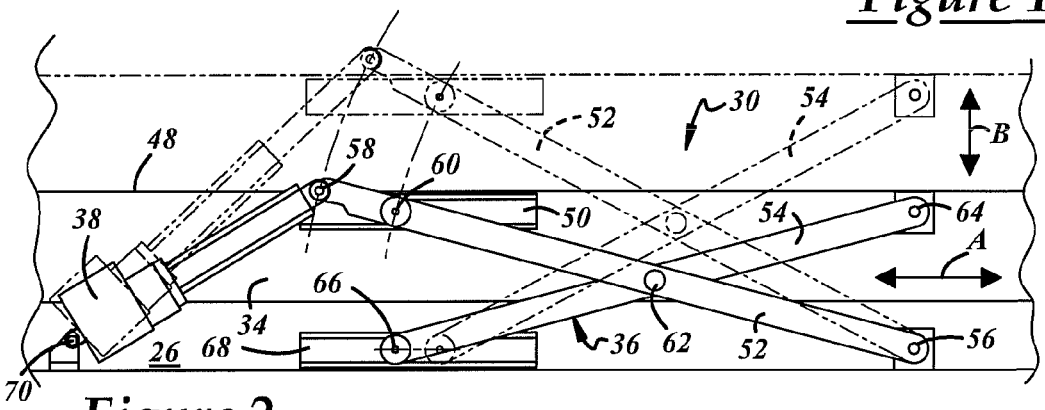
FIG. 2 is an enlarged view of the exemplary adjustable profile plate assembly of FIG. 1.

Depending on the arrangement and configuration of air make-up system 10, one or more adjustable profile plate assemblies can be used in the system. With reference to FIGS. 1 and 2, there is shown an exemplary embodiment of an adjustable profile plate assembly 30 that may be used with air make-up system 10 to influence or affect the outdoor air passing by heating element 16. By moving the profile plate back and forth (i.e., towards and away from the heating element), adjustable profile plate assembly 30 is able to influence the direction, speed, pressure and/or other characteristics of the incoming air flow. According to this embodiment, profile plate assembly 30 includes one or more mounting brackets 32 (FIG. 1), a profile plate 34, a linkage mechanism 36, an actuator 38, and an electronic control unit (ECU) 40.

Mounting bracket 32 is attached to the walls and/or ceiling of housing 12 and supports sliding adjustment of profile plate 34 so that it can move towards and away from heating element 16. Mounting bracket 32 spaces profile plate 34 away from ceiling 26 and in-line with, or slightly above, a firing end 42 of heating element 16, as best shown in FIG. 3. Other mounting positions are, of course, also possible. Mounting bracket 32 can have a number of different arrangements and configurations. In the embodiment of FIG. 1, mounting bracket 32 has a pair of triangular plates 44 mounted to side wall 24, though the mounting bracket can be mounted to another structure including a different part of housing 12 or a part distinct from the housing. Though not shown in detail, mounting bracket 32 can have a wheel and track, or any other suitable structure for guiding and promoting the sliding movement of profile plate 34. In other embodiments where components of linkage mechanism 36 support and position profile plate 34, mounting bracket 32 could be omitted, for example.

Profile plate 34 is a rigid plate or panel that may be moved towards and away from heating element 16 in order to influence the air-flow passing by the heating element. Referring to FIGS. 2 and 3, profile plate 34 has a body 46, a flange 48, and a U-shaped track 50. Body 46 is elongated in a lengthwise direction A such that its lengthwise dimension is greater than its widthwise dimension. Flange 48 is formed along a lengthwise edge of body 46, and though not shown, another flange may be formed along the opposing edge. U-shaped track 50 is located inboard of flange 48 and includes a channel that is designed to receive a wheel, bearing or other feature of linkage mechanism 36 in order to promote sliding movement within the channel. In the particular embodiment shown here, U-shaped track 50 is an elongated track that is tucked into a corner formed between body 46 and flange 48 and extends for only a fraction of the overall length of profile plate 34 (i.e., the U-shaped track does not extend the entire length of the profile plate, rather it only extends far enough to accommodate the sliding movement of a wheel 60). U-shaped track 50 can be located at other positions on body 46, including away from flange 48 and near a widthwise center of the body, for example. Also, U-shaped track 50 can extend for a greater or lesser lengthwise distance than the exemplary embodiment shown here. It should be appreciated that profile plate 34 could have more, less, and/or different components than shown and described here. For instance, flange 48 could be omitted from profile plate 34 such that the profile plate terminated in an unflanged-edge.

Linkage mechanism 36 converts motion from actuator 38 into sliding movement of profile plate 34 towards and away from heating element 16. Linkage mechanism 36 can come in various arrangements and configurations including the scissor-type design shown in the drawings. The scissor-type mechanism has a first arm member 52 and a second arm member 54. First arm member 52 is pivotally connected at one end to housing 12 by a first attachment portion 56, and is pivotally connected at its other end to actuator 38 by a second attachment portion 58. First arm member 52 has a wheel 60 that slides within the U-shaped track under the power of actuator 38 in order to facilitate movement of profile plate 34. Second arm member 54 is pivotally connected to first arm member 52 at a third attachment portion 62, allowing the arm members to pivot about the third attachment portion in a scissor-like manner. Second arm member 54 is also pivotally connected at one end to profile plate 34 by a fourth attachment portion 64. A wheel 66 is rotatably attached to second arm member 54 and slides within a U-shaped track 68 that is mounted to housing 10.

It should be appreciated that linkage mechanism 36 could have more, less, and/or a different combination of components than that shown and described here. For example, four arm members could be pivotally connected to one another to form a pair of scissor-like connections in tandem, or a single arm member could be pivotally connected to actuator 38 and housing 12 at its other end. Indeed, linkage mechanism 36 is not necessary in embodiments where actuator 38 is directly connected to profile plate 34 and drives the profile plate along mounting brackets or other pieces towards and away from heating element 16 without the assistance of a linkage mechanism. And linkage mechanism 36 need not be of a scissor-type, as it could be implemented in a number of other configurations known to those skilled in the art.

Actuator 38 drives linkage mechanism 36 so that profile plate 34 can move in a lateral or widthwise direction B, thus, influencing the flow of air into air make-up system 10. Actuator 38 can come in various configurations and arrangements including a linear actuator that pushes and pulls linkage mechanism 36 under the power of an electric motor. An example of a suitable linear actuator is supplied by Magnetic ElektroMotoren AG of Switzerland (www.magnetic-drives.com) under the model number MAX31-A150, which has a stroke length of 6 inches, a 1,798 lb push-force and a 1,349 lb pull force. Of course, other actuators, linear and otherwise, could be used and will depend on various requirements of the particular profile plate assembly, including the dimensions of the profile plate. Referring to FIG. 2, actuator 38 is pivotally connected at one end to first arm member 52 by first attachment portion 58, and is fixed at its other end to side wall 24 by a fifth attachment portion 70. It should be appreciated that actuator 38 could have more, less, and/or different components and could be mounted in an arrangement other than that shown and described here. For instance, a heat shield could be mounted around actuator 38 to protect the actuator from heat generated by heating element 16, or the actuator could be a linear actuator of another type including a pneumatic or hydraulic type. Indeed, actuator 38 need not be a linear actuator and instead could be a rotary actuator, for example, where the rotational motion of the rotary actuator is converted into a linear motion that drives profile plate 34.

ECU 40 is an electronic control unit that may control actuator 38 based on one or more operating parameters of air make-up system 10. In one embodiment, ECU 40 includes a programmable logic controller (PLC) which automates operation of profile plate assembly 30. ECU 40 has an electronic input 72 coupled to one or more devices of air make-up system 10, and has an electronic output 74 coupled to actuator 38. Electronic input 72 may receive signals from air make-up system 10 that indicate the operational status of different devices such as fans 22. The operational status could pertain to whether each fan is currently in an 'on' or 'off' state, or it could relate to the operational mode of each fan (e.g., a low speed, medium speed or high speed mode), to cite two examples. ECU 40 processes the received signals and determines a control signal based thereon. Electronic output 74, in turn, sends the control signal to actuator 38 which commands the actuator to move linkage mechanism 36 in a certain direction, for a certain distance, at a certain speed, or according to some other operating parameters. This is an example of an adjustable profile plate assembly 30 having a feedback control loop. In some embodiments, ECU 40 could allow for manual control of actuator 38, where an operator controls the actuator independent of the operating parameters of air make-up system 10. This is an example of an adjustable profile plate assembly without a feedback control loop.

In operation, profile plate assembly 30 moves profile plate 34 towards and away from heating element 16 (widthwise direction B) in order to influence or control the outdoor airflow that is being drawn into air make-up system 10 from the outside. Referring to the embodiment of FIG. 3, when actuator 38 drives linkage mechanism 36, profile plate 34 slides in the widthwise direction B along mounting bracket 32, back and forth with respect to the firing end 42 of heating element 16. More specifically, linear extension of actuator 38 pushes first arm member 52 outwards, towards heating element 16. This in turn causes wheels 60 and 66 to respectively slide in U-shaped channels 50 and 68, and causes attachment portions 56, 58, 62 and 64 to rotate about their respective joints. The resulting scissor-like action pushes profile plate 34 outwards in the widthwise direction B while generally limiting any movement in the lengthwise direction A. Control of actuator 38 can be automatic (e.g., using a feedback control loop) or manual where an operator turns the actuator on and manually instructs it to perform a certain task.

In an automated example where movement is based on operating parameters of air make-up system 10, such as the operational state of fans 22, ECU 40 may periodically adjust the position of the profile plate in order to achieve a desired airflow pattern, velocity, pressure drop, etc. Consider the example where one fan 22 is 'on' and a second fan 22 is 'off', the ECU can receive signals representing these conditions on input 72. By using an algorithm or other type of executable program, ECU 40 can derive a command or control signal to send to actuator 38 on output 74. It should be appreciated that while the preceding example uses the operational states of fans 22 as input to the feedback control loop, any number of other inputs could be used as well. Other suitable inputs could include sensed airflow volume, sensed airflow speed, sensed air temperature, etc. Furthermore, the algorithm or instructions executed within ECU 40 could be designed to maintain a desired velocity and pressure-drop to ensure proper combustion and heating in heated air make-up system 10. When second fan 22 is turned back on, profile plate 34 could be automatically moved away from firing end 42, for example. Of course, other examples of automatic control are possible.

It is to be understood that the foregoing description is not a definition of the invention, but is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. An adjustable profile plate assembly for use with an air make-up system, comprising:

a profile plate with a track that extends in a lengthwise direction of the profile plate;

a linkage mechanism attached to the profile plate and the air make-up system, the linkage mechanism is a scissor-type mechanism that includes a wheel slidably received in the track of the profile plate and that adjusts the position of the profile plate by moving it in a widthwise direction towards and away from a heating element of the air make-up system; and an actuator attached to the linkage mechanism and the air make-up system, wherein electronic activation of the actuator drives the actuator and causes the linkage mechanism to adjust the position of the profile plate.

2. The assembly of claim 1, wherein the scissor-type mechanism includes a first arm member that is pivotally connected to the actuator, and a second arm member that is pivotally connected to both the first arm member and the profile plate.

3. The assembly of claim 2, wherein the air make-up system and the profile plate each includes a track, and the first and second arm members each includes a wheel, and the wheels of the first and second arm members slide back and forth in the tracks of the profile plate and air make-up system, respectively, when the position of the profile plate is adjusted.

4. The assembly of claim 1, wherein the actuator is a linear actuator and includes an electric motor.

5. The assembly of claim 1, further comprising at least one mounting bracket that is mounted to the air make-up system and supports the profile plate as its position is adjusted.

6. The assembly of claim 5, wherein the mounting bracket generally restrains the movement of the profile plate such that the profile plate can only be adjusted in a widthwise direction upon activation of the actuator.

7. The assembly of claim 1, further comprising an electronic control unit having an electronic input coupled to the air make-up system and having an electronic output coupled to the actuator, wherein during operation: i) the electronic input receives at least one operating parameter from the air make-up system, ii) the electronic control unit uses the operating parameter to determine a control signal for controlling the actuator, and iii) the electronic output sends the control signal to the actuator.

8. The assembly of claim 7, wherein the at least one operating parameter pertains to the state of one or more fans in the air make-up system.

9. An air make-up system, comprising:

a housing that has an air inlet for admitting outdoor air;

a heating element that is located downstream of the air inlet;

at least one fan that is located downstream of the heating element and draws air through the air inlet and across the heating element; and the assembly of claim 1, wherein the position of the profile plate is adjusted in a widthwise direction towards and away from the heating element in order to influence the air flowing through the air make-up system.

10. The air make-up system of claim 9, further comprising a second adjustable profile plate assembly located on a side of the heating element that is opposite the first assembly, wherein the position of the second profile plate adjusts in a widthwise direction towards and away from the heating element in order to influence the air flowing through the air make-up system.

11. An adjustable profile plate assembly for use with an air make-up system, comprising:

at least one mounting bracket mounted to the air make-up system;

an elongated profile plate slidably supported by the mounting bracket, the elongated profile plate having a lengthwise dimension that is greater than a widthwise dimension and a track that extends in a lengthwise direction;

a scissor-type linkage mechanism attached to the elongated profile plate and the air make-up system and having a wheel slidably received in the track of the profile plate;

an actuator attached to the scissor-type linkage mechanism and the air make-up system, wherein activation of the actuator causes the elongated profile plate to move back and forth in the widthwise; and an electronic control unit having an electronic input coupled to the air make-up system and having an electronic output coupled to the actuator, wherein during operation: i) the electronic input receives at least one operating parameter from the air make-up system, ii) the electronic control unit uses the operating parameter to determine a control signal for controlling the actuator, and iii) the electronic output sends the control signal to the actuator.

* * * * *